US006119792A

United States Patent [19]

Almer

[11] Patent Number: 6,119,792

[45] Date of Patent: Sep. 19, 2000

[54] LAND SMOOTHER AND PACKER SYSTEM

[76] Inventor: Alvin D. Almer, 940 Hwy. #3, Tuttle, N. Dak. 58488-9441

[21] Appl. No.: 09/289,086

[22] Filed: Apr. 8, 1999

[51] Int. Cl.[7] ..... E02F 3/76

[52] U.S. Cl. ..... 172/799.5; 172/171; 172/175; 172/199; 172/311; 172/452

[58] Field of Search ..... 172/799.5, 170, 172/171, 174, 175, 176, 179, 185, 187, 199, 327, 407, 413, 423, 457, 452, 536, 311, 459, 460

[56] References Cited

U.S. PATENT DOCUMENTS

| | | | |
|---|---|---|---|
| 39,412 | 8/1863 | Markham | 172/170 |
| 367,736 | 8/1887 | Wise et al. | 172/170 |
| 903,782 | 11/1908 | Ross | 172/170 |
| 1,428,319 | 9/1922 | Brannan | 172/452 X |
| 1,702,196 | 2/1929 | Cole | 172/170 |
| 3,110,973 | 11/1963 | Reynolds | 37/176 |
| 3,448,814 | 6/1969 | Bentley et al. | 172/170 X |
| 3,889,760 | 6/1975 | Manor | 172/175 |
| 3,993,413 | 11/1976 | Cox et al. | 172/452 X |
| 4,098,344 | 7/1978 | Johnson | 172/170 X |
| 4,399,875 | 8/1983 | Schaaf et al. | 172/311 |
| 4,418,763 | 12/1983 | Boetto | 172/311 X |
| 4,452,318 | 6/1984 | Boetto | 172/311 |
| 4,479,549 | 10/1984 | Fegley | 172/142 |
| 4,489,789 | 12/1984 | Pearce | 172/443 |
| 4,561,504 | 12/1985 | Andersen | 172/142 |
| 4,813,489 | 3/1989 | Just et al. | 172/311 X |
| 4,821,809 | 4/1989 | Summach et al. | 172/311 X |
| 4,836,295 | 6/1989 | Estes | 172/170 X |
| 5,303,779 | 4/1994 | Friggstad | 172/311 |
| 5,487,429 | 1/1996 | Gates | 172/175 |
| 5,715,893 | 2/1998 | Houck | 172/311 |
| 5,921,324 | 7/1999 | Anderson | 172/176 |

FOREIGN PATENT DOCUMENTS

| | | | |
|---|---|---|---|
| 182987 | 3/1918 | Canada | 172/170 |
| 253233 | 8/1926 | Italy | 172/170 |
| 1521312 | 11/1989 | U.S.S.R. | 172/170 |

*Primary Examiner*—Christopher J. Novosad
*Attorney, Agent, or Firm*—Michael S. Neustel

[57] ABSTRACT

A land smoother and packer system for smoothing and packing irregularities in a ground surface. The inventive device includes a frame, a plurality of wheels, a right blade pivotally attached to the frame, a center blade attached to the frame, a left blade pivotally attached to the frame, and a plurality of rollers rotatably attached to the frame behind the blades. The frame has a center portion, a left wing and a right wing that fold upon the center portion for travel. A pair of hydraulic cylinders are attached to the right blade and the left blade for controlling the rotational position of the respective blades. The plurality of rollers are preferably comprised of a center roller, a right roller, a left roller, a right rear roller, and a left rear roller. In operation, the blades are lowered to the desired level for leveling the ground surface of dirt mounds. The rollers follow behind the blades thereby packing the ground surface and forcing any rocks into the ground surface.

7 Claims, 6 Drawing Sheets

LAND SMOOTHER AND PACKER SYSTEM

BACKGROUND OF THE INVENTION

1. Field of the Invention

The present invention relates generally to land leveling devices and more specifically it relates to a land smoother and packer system for smoothing and packing irregularities in a ground surface.

Fields and pastures often have mounds of dirt, rocks and ravines that are difficult to navigate with machinery and equipment. Dirt mounds are created by gophers, ground squirrels, badgers, foxes moles and other rodents. Dirt mounds created by animals often times contaminate a whole field. Ravines are created by water runoff within hilly land. Mounds of dirt and rocks cause a field to be extremely rough for a user to navigate through causing them to drive slower. Mounds of dirt and rocks also cause damage to machinery such as mowers and swathers. Hence, there is a significant need for an implement that will smooth and pack a ground surface to reduce mounds of dirt, rocks and ravines.

2. Description of the Prior Art

Ground leveling devices have been in use for years. Typically, a ground lever includes vehicles such as maintainers. A conventional ground leveling device generally has only one blade. Most conventional ground leveling devices allow the blade to be pivoted for directing the flow of dirt. Conventional ground leveling devices allow the ground surface to be graded, however conventional ground leveling devices are not designed for skimming a ground surface for removing irregularities in the ground surface.

Examples of ground leveling devices include U.S. Pat. No. 3,889,760 to Manor; U.S. Pat. No. 3,110,973 to A. G. Reynolds; U.S. Pat. No. 3,448,814 to T. A. Bentley, et al; Pat. No. 90-169676 to Buldeskul; U.S. Pat. No. 4,821,809 to Summach et al; U.S. Pat. No. 5,487,429 to Gates; U.S. Pat. No. 4,813,489 to Just et al; U.S. Pat. No. 4,479,549 to Fegley; U.S. Pat. No. 900,822 to S. D. Beum which are all illustrative of such prior art.

Manor (U.S. Pat. No. 3,889,760) discloses a combined smoother and roller-packer assembly. Manor teaches a straight blade with a pair of side shields, a three-point hitch, ad a roller-packer.

A. G. Reynolds (U.S. Pat. No. 3,110,973) discloses a land smoother system. A. G. Reynolds teaches a pair of blades disposed forwardly of the wheels while a third blade rearwardly of the wheels has its front face tilted forwardly at a steeper angle with respect to the horizontal ground surface.

T. A. Bentley, et al (U.S. Pat. No. 3,448,814) discloses a grader bucket construction. Bentley teaches a bucket having a lower scraping edge at the rear of the bucket, plow blades at the front of the bucket, raking tines between the scraping edge and the plow blades, and a grooved roller mounted to the rear of the bucket rear.

While these devices may be suitable for the particular purpose to which they address, they are not as suitable for smoothing and packing irregularities in a ground surface. Conventional ground levelers do not provide a packing system that packs the ground surface after the grading.

In these respects, the land smoother and packer system according to the present invention substantially departs from the conventional concepts and designs of the prior art, and in so doing provides an apparatus primarily developed for the purpose of smoothing and packing irregularities in a ground surface.

SUMMARY OF THE INVENTION

In view of the foregoing disadvantages inherent in the known types of ground leveling devices now present in the prior art, the present invention provides a new land smoother and packer system construction wherein the same can be utilized for smoothing and packing irregularities in a ground surface.

The general purpose of the present invention, which will be described subsequently in greater detail, is to provide a new land smoother and packer system that has many of the advantages of the ground leveling devices mentioned heretofore and many novel features that result in a new land smoother and packer system which is not anticipated, rendered obvious, suggested, or even implied by any of the prior art ground leveling devices, either alone or in any combination thereof.

To attain this, the present invention generally comprises a frame, a plurality of wheels, a right blade pivotally attached to the frame, a center blade attached to the frame, a left blade pivotally attached to the frame, and a plurality of rollers rotatably attached to the frame behind the blades. The frame has a center portion, a left wing and a right wing that fold upon the center portion for travel. A pair of hydraulic cylinders are attached to the right blade and the left blade for controlling the rotational position of the respective blades. The plurality of rollers are preferably comprised of a center roller, a right roller, a left roller, a right rear roller, and a left rear roller. In operation, the blades are lowered to the desired level for leveling the ground surface of dirt mounds. The rollers follow behind the blades thereby packing the ground surface and forcing any rocks into the ground surface.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a land smoother and packer system that will overcome the shortcomings of the prior art devices.

Another object is to provide a land smoother and packer system that smoothes irregularities in a ground surface.

An additional object is to provide a land smoother and packer system that decreases the time it takes to harvest a field thereby saving money for the farmer.

A further object is to provide a land smoother and packer system that reduces the amount of downtime a farmer incurs.

Another object is to provide a land smoother and packer system that simultaneously smoothes and packs a field.

A further object is to provide a land smoother and packer system that can be utilized upon existing hay fields without damaging the existing plants.

An additional object is to provide a land smoother and packer system that is capable of windrowing rocks and other debris.

A further object is to provide a land smoother and packer system that smoothes mounds of dirt created by animals.

Another object is to provide a land smoother and packer system that may be utilized upon a dirt or gravel road for resurfacing the road.

Another object is to provide a land smoother and packer system that forces rocks into the ground surface.

A further object is to provide a land smoother and packer system that levels and smoothes boggy sloughs.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 4 is a front view of the present invention.

DESCRIPTION OF THE PREFERRED EMBODIMENT

Figure 1:
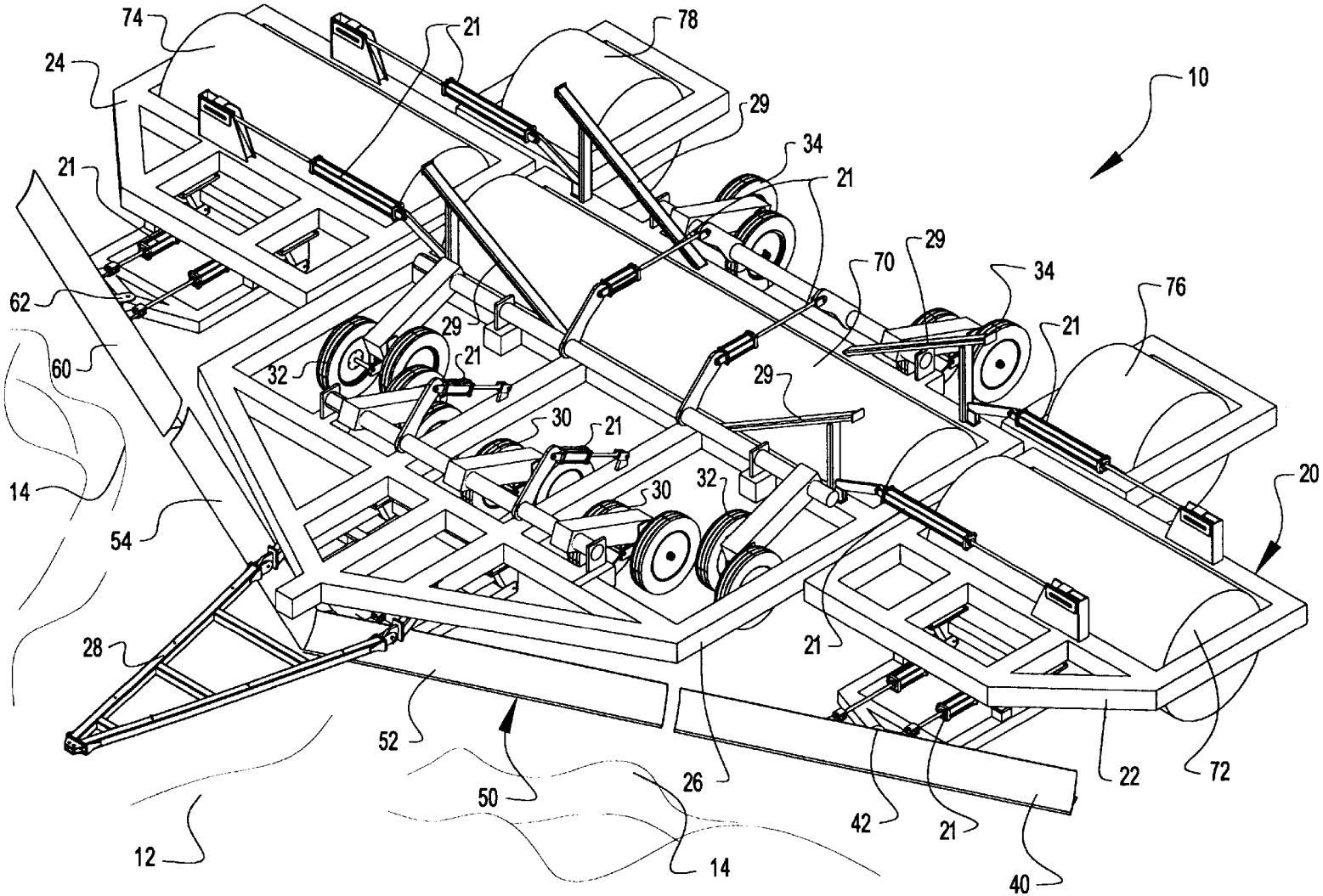
FIG. 1 is an upper perspective view of the present invention.

Turning now descriptively to the drawings, in which similar reference characters denote similar elements throughout the several view, FIGS. 1 through 6 illustrate a land smoother and packer system 10, which comprises a frame 20, a plurality of wheels, a right blade 40 pivotally attached to the frame 20, a center blade 50 attached to the frame 20, a left blade 60 pivotally attached to the frame 20, and a plurality of rollers rotatably attached to the frame 20 behind the blades. The frame 20 has a center portion 26, a left wing 24 and a right wing 22 that fold upon the center portion 26 for travel. A pair of hydraulic cylinders 21 are attached to the right blade 40 and the left blade 60 for controlling the rotational position of the respective blades. The plurality of rollers are preferably comprised of a center roller 70, a right roller 72, a left roller 74, a right rear roller 76, and a left rear roller 78. In operation, the blades are lowered to the desired level for leveling the ground surface 12 of dirt mounds 14. The rollers follow behind the blades thereby packing the ground surface 12 and forcing any rocks into the ground surface 12.

Figure 2:
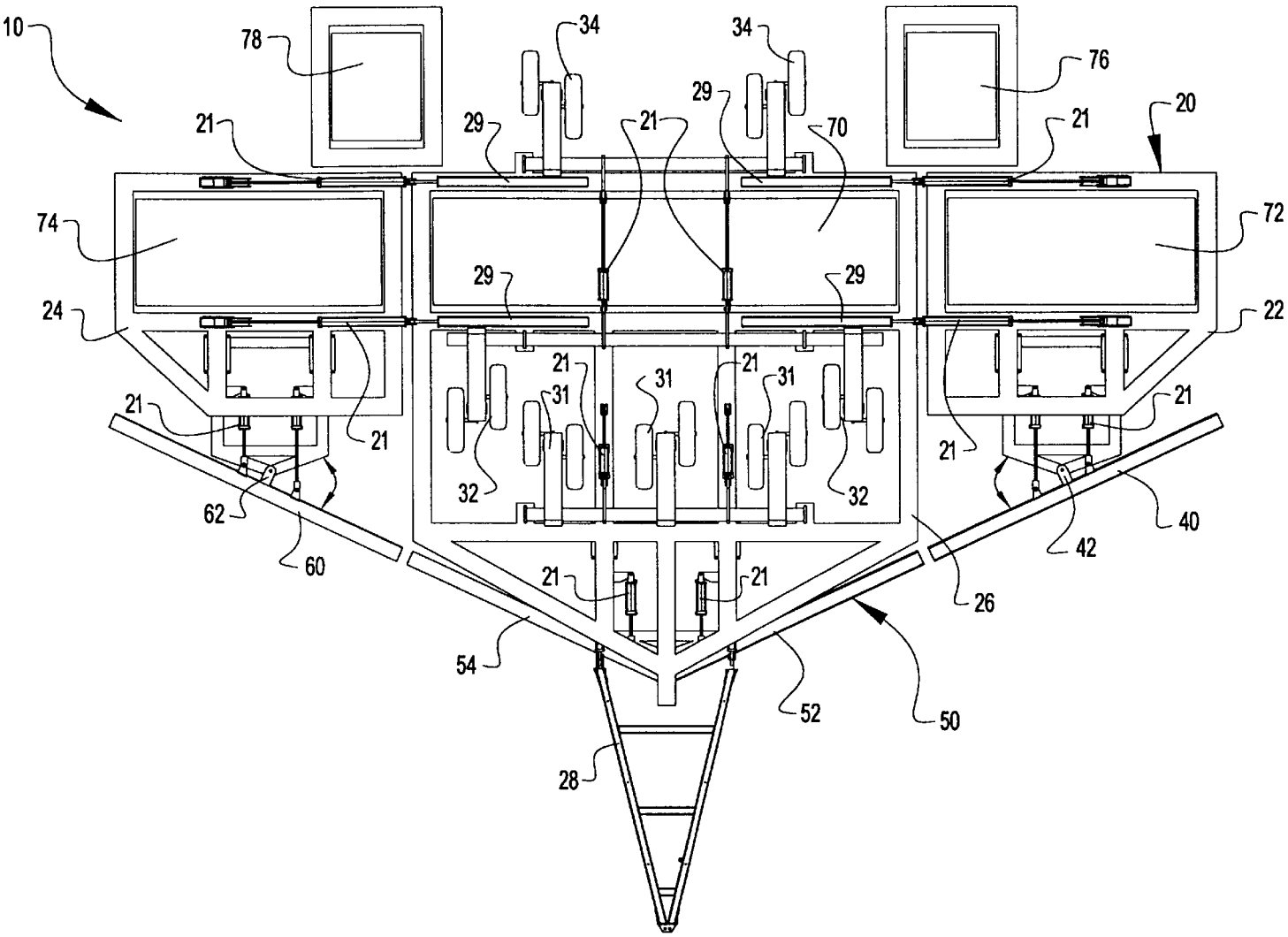
FIG. 2 is a top view of the present invention.
Figure 3:
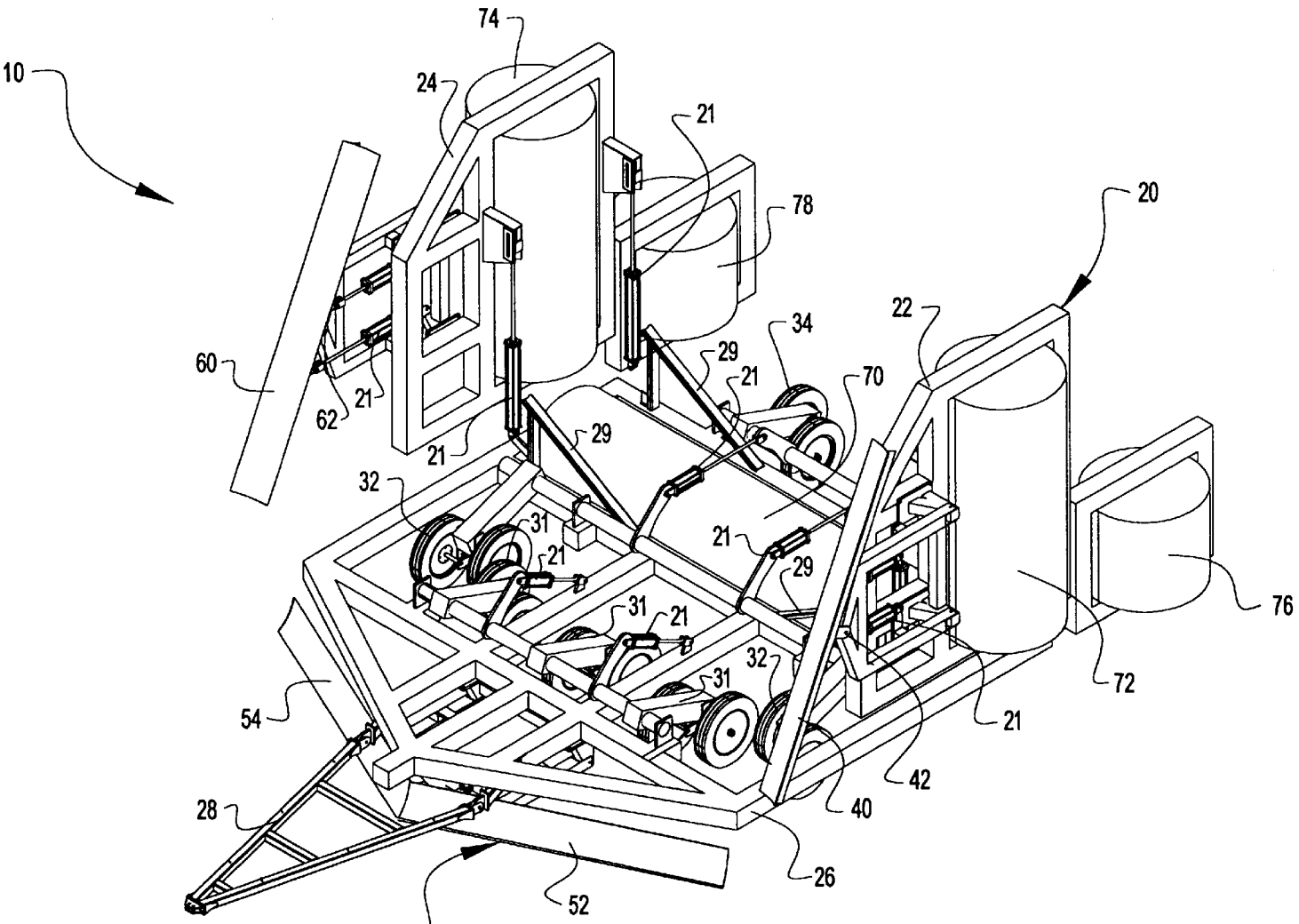
FIG. 3 is an upper perspective view of the present invention with the wings folded upwardly for transporting.
Figure 1:
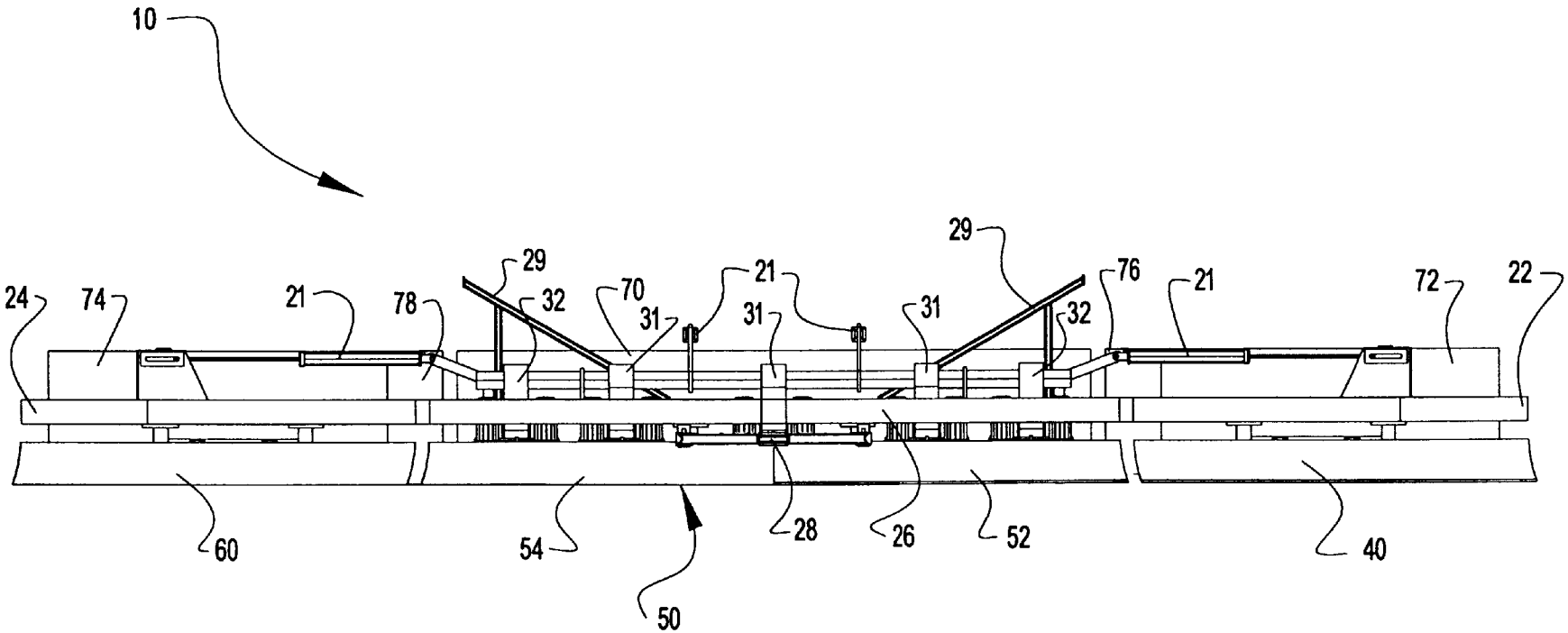
Figure 5:
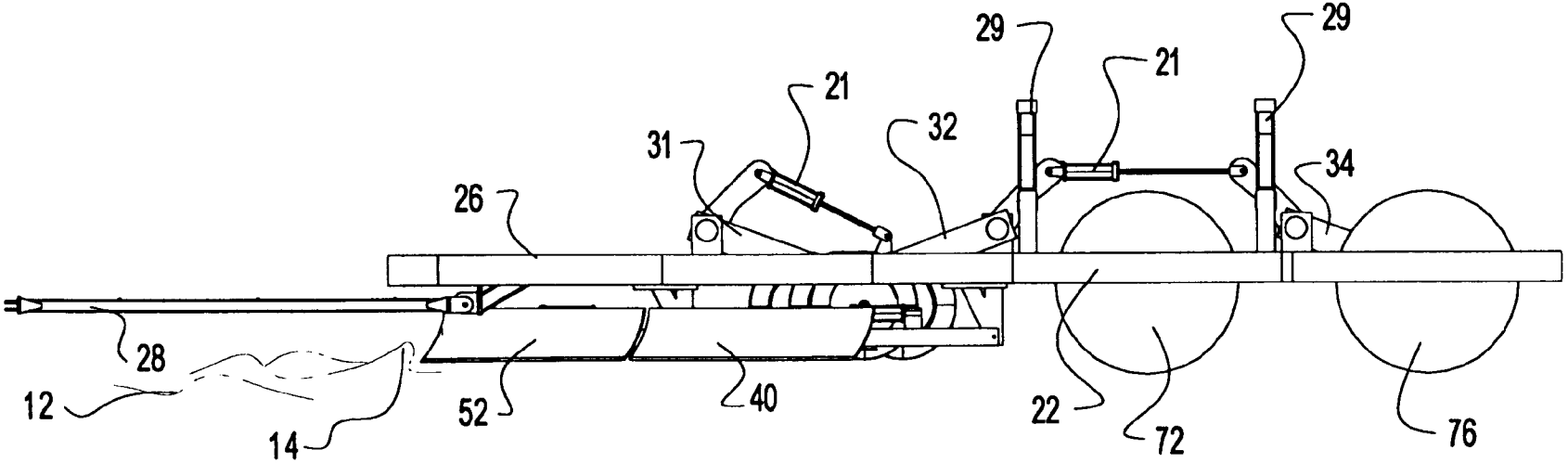
FIG. 5 is a side view of the present invention in operation.
Figure 6:
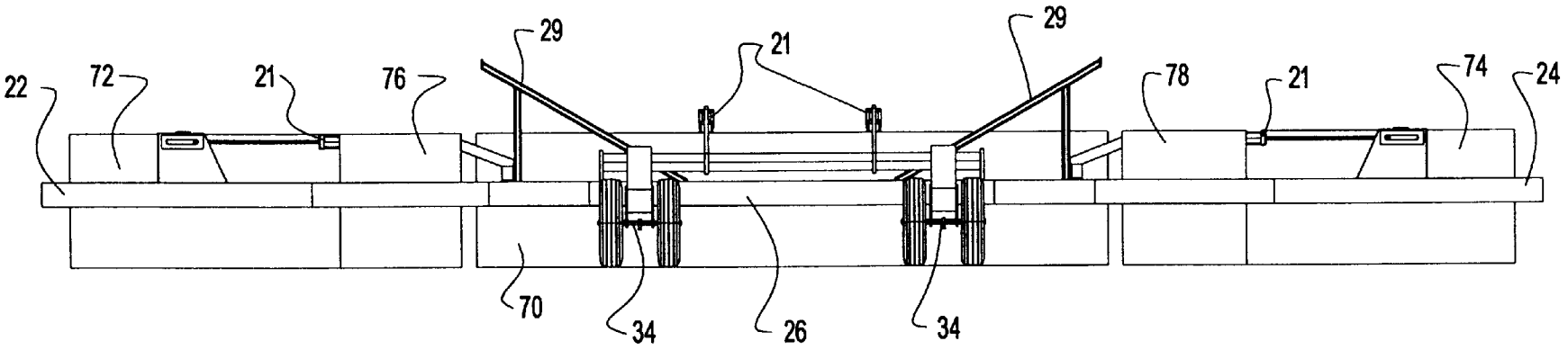
FIG. 6 is a rear view of the present invention.

As best shown in FIGS. 1 through 3 of the drawings, the frame 20 has a rectangular shaped center portion 26. As shown in FIG. 1, a hitch 28 is attached to the center portion 26 of the frame 20. A pair of support brackets 29 are attached to the center portion 26 for supporting the left wing 24 and the right wing 22 when in the transportation position. The frame 20 may be constructed of any well-known material.

A plurality of front wheels 30 are rotatably and pivotally attached to the center portion 26 of the frame 20. The front wheels 30 are raised/lowered by a pair of hydraulic cylinders 21 as best shown in FIG. 1 of the drawings. A plurality of middle wheels 32 and a plurality of rear wheels 34 are rotatably and pivotally attached to the center portion 26 of the frame 20. The middle wheels 32 and the rear wheels 34 are raised/lowered by a pair of hydraulic cylinders 21 as best shown in FIG. 1 of the drawings.

A left wing 24 is pivotally attached to the center portion 26 as shown in FIGS. 1 through 3 of the drawings. The left wing 24 is substantially rectangular in shape and engages the support brackets 29 when in the storage position. When in the lowered position, the left wing 24 is allowed to freely float about the center portion 26. A pair of hydraulic cylinders 21 are attached between the center portion 26 and the left wing 24 for allowing the user to pull the left wing 24 into a storage position about the support brackets 29 as shown in FIG. 3 of the drawings.

A right wing 22 is pivotally attached to the center portion 26 as shown in FIGS. 1 through 3 of the drawings. The right wing 22 is substantially rectangular in shape and engages the support brackets 29 when in the storage position. When in the lowered position, the right wing 22 is allowed to freely float about the center portion 26. A pair of hydraulic cylinders 21 are attached between the center portion 26 and the right wing 22 for allowing the user to pull the right wing 22 into a storage position about the support brackets 29 as shown in FIG. 3 of the drawings.

As shown in FIGS. 1 through 4 of the drawings, the center blade 50 is attached to the center portion 26 of the frame 20. The center blade 50 is preferably V-shaped having a right section 52 and a left section 54. The center blade 50 preferably has a curved cross sectional area and has a lower edge that is substantially parallel to the horizontal.

As shown in FIG. 2 of the drawings, the right blade 40 is pivotally attached to the right wing 22 by a right hinge 42. A pair of hydraulic cylinders 21 are attached to opposing sides of the right hinge 42 for manipulating the rotational position of the right blade 40. The right blade 40 may be parallel to the right section 52 of the center blade 50 or traverse to the right section 52. The right blade 40 preferably has a curved cross sectional area and has a lower edge that is substantially parallel to the horizontal.

As shown in FIG. 2 of the drawings, the left blade 60 is pivotally attached to the left wing 24 by a left hinge 62. A pair of hydraulic cylinders 21 are attached to opposing sides of the left hinge 62 for manipulating the rotational position of the left blade 60. The left blade 60 may be parallel to the left section 54 of the center blade 50 or traverse to the left section 54. The left blade 60 preferably has a curved cross sectional area and has a lower edge that is substantially parallel to the horizontal.

As shown in FIGS. 1 through 3 of the drawings, a center roller 70 is rotatably positioned within the center portion 26 of the frame 20. The center roller 70 is approximately the width of the center blade 50 and is attached to the rear portion of the center portion 26.

As shown in FIG. 1 of the drawings, a right roller 72 is rotatably positioned within the right wing 22 of the frame 20. The right roller 72 is approximately the width of the right blade 40 and is attached to the rear portion of the right wing 22. The right roller 72 is preferably shorter in length than the center roller 70 as shown in FIG. 2 of the drawings.

As shown in FIG. 1 of the drawings, a left roller 74 is rotatably positioned within the left wing 24 of the frame 20. The left roller 74 is approximately the width of the left blade 60 and is attached to the rear portion of the left wing 24. The left roller 74 is preferably shorter in length than the center roller 70 as shown in FIG. 2 of the drawings.

As shown in FIGS. 1 through 6 of the drawings, a right rear roller 76 is rotatably positioned within the rear portion of the right wing 22 of the frame 20. The right rear roller 76 is positioned between the gap between the center roller 70 and the right roller 72 for ensuring complete coverage of the ground surface 12.

As shown in FIGS. 1 through 6 of the drawings, a left rear roller 78 is rotatably positioned within the left portion of the left wing 24 of the frame 20. The left rear roller 78 is positioned between the gap between the center roller 70 and the left roller 74 for ensuring complete coverage of the ground surface 12.

In use, the user connects the hitch 28 and hydraulic cylinders 21 to a tractor. The user first positions the right blade 40 and the left blade 60. If the user desires to windrow rocks, the blades 40, 60 are parallel to the right section 52 and left section 54 of the center blade 50. If the user desires to only level a ground surface 12 without rocks, the blades 40, 60 are preferably positioned traversely to the center blade 50. The user then adjusts the height of the frame 20 so that the lower edge of the blades 40, 50, 60 is at the desired height or depth of the ground surface 12. The user then pulls the invention forwardly with the tractor with the blades 40, 50, 60 engaging a lower portion of the dirt mounds 14 thereby severing the dirt mounds 14 and distributing the dirt about a broad flat area. The rollers 70, 72, 74, 76, 78 follow behind the blades 40, 50, 60 thereby compacting the newly distributed dirt and debris. The rollers 70, 72, 74, 76, 78 also force any hard debris such as rocks deep into the ground surface 12. The user continues to operate the invention over the field until completed. The field is thereafter easily traveled by the user and others without fear of damaging equipment and without undue roughness.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

| Index of Elements for Land Smoother and Packer System<br>ENVIRONMENTAL ELEMENTS |
|---|
| 10. Land Smoother and Packer System |
| 11. |
| 12. Ground Surface |
| 13. |
| 14. Dirt Mounds |

-continued

| Index of Elements for Land Smoother and Packer System<br>ENVIRONMENTAL ELEMENTS |
|---|
| 15. |
| 16. |
| 17. |
| 18. |
| 19. |
| 20. Frame |
| 21. Hydraulic Cylinders |
| 22. Right Wing |
| 23. |
| 24. Left Wing |
| 25. |
| 26. Center Portion |
| 27. |
| 28. Hitch |
| 29. Support Brackets |
| 30. Front Wheels |
| 31. |
| 32. Middle Wheels |
| 33. |
| 34. Rear Wheels |
| 35. |
| 36. |
| 37. |
| 38. |
| 39. |
| 40. Right Blade |
| 41. |
| 42. Right Hinge |
| 43. |
| 44. |
| 45. |
| 46. |
| 47. |
| 48. |
| 49. |
| 50. Center Blade |
| 51. |
| 52. Right Section |
| 53. |
| 54. Left Section |
| 55. |
| 56. |
| 57. |
| 58. |
| 59. |
| 60. Left Blade |
| 61. |
| 62. Left Hinge |
| 63. |
| 64. |
| 65. |
| 66. |
| 67. |
| 68. |
| 69. |
| 70. Center Roller |
| 71. |
| 72. Right Roller |
| 73. |
| 74. Left Roller |
| 75. |
| 76. Right Rear Roller |
| 77. |
| 78. Left Rear Roller |
| 79. |

I claim:

1. A land smoother and packer system, comprising:

a frame;

at least one roller rotatably attached to a rear portion of said frame, wherein said at least one roller includes a solid outer surface;

a plurality of wheels adjustably connected to said frame for adjustably supporting said frame upon a ground surface;

wherein said frame comprises:

a center portion:

a first wing pivotally attached to said center portion; and a second wing pivotally attached to said center portion opposite of said first wing;

a center blade attached to said center portion of said frame, wherein said center blade extends about a substantial portion of said center portion;

a first blade attached to said first wing, wherein said first blade extends about a substantial portion of said first wing; and a second blade attached to said second wing, wherein said second blade extends about a substantial portion of said second wing.

2. The land smoother and packer system of claim 1, wherein said first blade and said second blade are pivotally attached to said first wing and said second wing respectively.

3. The land smoother and packer system of claim 2, including:

a first adjustment means mechanically connected between said first wing and said first blade for adjusting and maintaining a rotational position of said first blade; and a second adjustment means mechanically connected between said second wing and said second blade for adjusting and maintaining a rotational position of said second blade.

4. The land smoother and packer system of claim 1, wherein said at least one roller comprises:

a center roller rotatably attached within said center portion;

a first roller rotatably attached within said first wing; and a second roller rotatably attached within said second wing.

5. The land smoother and packer system of claim 4, including a third roller rotatably attached to said frame behind and between said center roller and said first roller, and a fourth roller rotatably attached to said frame behind and between said center roller and said second roller.

6. The land smoother and packer system of claim 1, wherein said center blade is V-shaped.

7. The land smoother and packer system of claim 1, wherein said center blade, said first blade and said second blade each have a curved cross sectional area.

* * * * *